United States Patent [19]

Labecki

[11] 4,104,768

[45] Aug. 8, 1978

[54] FASTENING DEVICE

[75] Inventor: Karl W. Labecki, Meadville, Pa.

[73] Assignee: Textron Inc., Providence, R.I.

[21] Appl. No.: 800,479

[22] Filed: May 25, 1977

[51] Int. Cl.[2] ..... A44G 19/00

[52] U.S. Cl. ..... 24/207; 24/206 R; 24/70 R

[58] Field of Search ..... 24/207, 267, 70

[56] References Cited

U.S. PATENT DOCUMENTS

| | | | |
|---|---|---|---|
| 2,983,019 | 5/1961 | Rae | 24/207 |
| 3,122,810 | 3/1964 | Lawrence | 24/207 |
| 3,703,024 | 11/1972 | Johnson | 24/71 R |
| 3,999,256 | 12/1976 | MacFee | 24/207 |

*Primary Examiner*—Bernard A. Gelak

*Attorney, Agent, or Firm*—O'Brien and Marks

[57] ABSTRACT

A fastening device used to operate a closure in a shoe or other object includes a grasshopper spring, a yoke spring and a molded thermoplastic plate member. A journal member of the plate member is molded around a connecting portion of the grasshopper spring and a series of slotted adjustment holes are formed in the plate member to selectively receive locking pins on the yoke member.

1 Claim, 3 Drawing Figures

FIG. 1
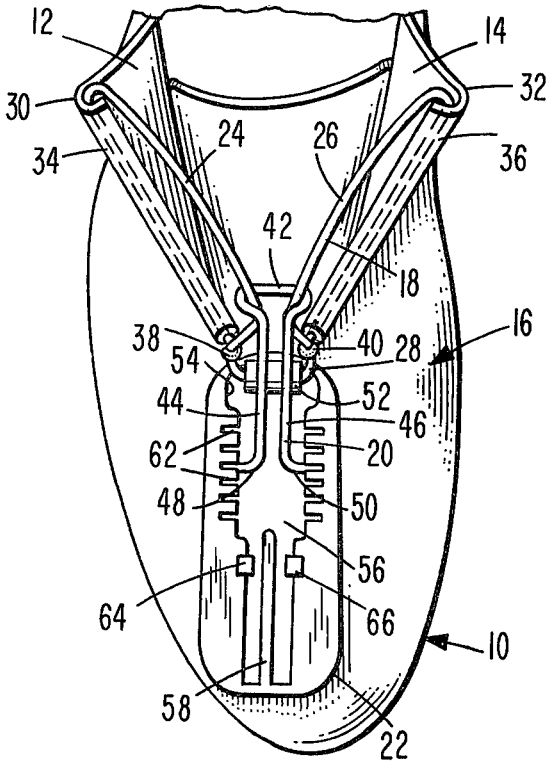
FIG. 2
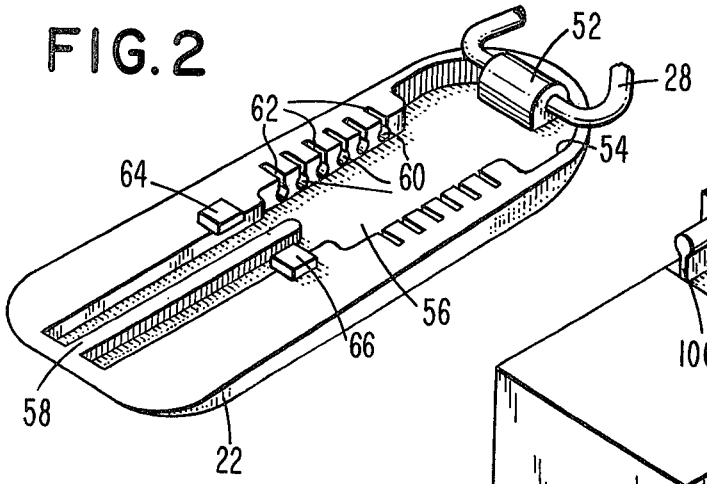
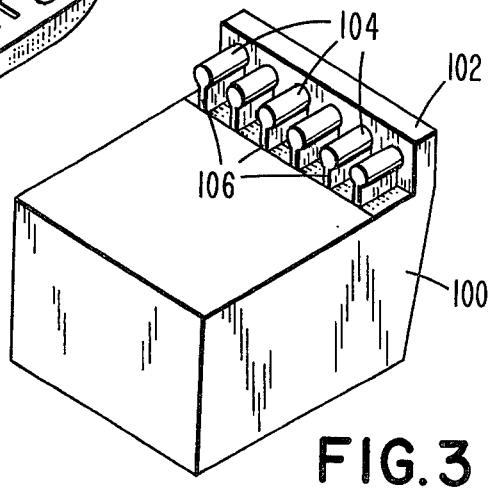
FIG. 3

FASTENING DEVICE

BACKGROUND OF THE INVENTION

1. Field of the Invention

The present invention relates to fastening devices in general and in particular to flip-up type closures popularly used in shoes, especially those for children.

2. Description of the Prior Art

The prior art does include at least one example, as explified by U.S. Pat. No. 3,999,256, of a shoe fastening device including a plate member formed of thermoplastic material. It is a disadvantage of the type of fastening device as disclosed in that patent that the plate member is difficult to manufacture in high volume because of the relatively large failure and scrap rate resulting from the relatively intricate manufacturing steps involved in making that plate member. The present invention is intended to overcome this problem. U.S. Pat. Nos. 2,983,019 and 3,122,810 show other flip-type shoe fasteners.

SUMMARY OF THE INVENTION

The present invention is summarized in that a fastening device for fastening a closure having two flaps includes a bent wire grasshopper spring including a connecting portion, a pair of arms extending from the connecting portion, a pair of arm extensions extending from the arms and attached to the closure flaps, and a hooked portion on each arm extension hooked onto the connecting portion, a yoke spring including a yoke portion looped over the arms of the grasshopper spring, a pair of legs extending in parallel from the yoke portion and a locking pin extending outwardly from each leg, a molded thermoplastic plate member having a longitudinally elongated yoke channel formed in its back surface, a journal member formed on one end of the back surface of the plate member, the journal member being integrally molded around the connecting portion of the grasshopper spring so that the connection portion is freely pivotable but is securely retained within the journal member, and the plate member having formed in it along the sides of the yoke channel a plurality of slotted adjustment holes adjacent to receiving the locking tabs of the yoke spring, each of the slotted adjustment holes being slotted towards the back surface of the plate member so that the adjustment holes can be more easily formed in the plate member.

It is an object of the present invention to construct a flip-up type shoe fastener in which the plate member is an economical thermoplastic molded member.

It is another object of the present invention to provide such a fastener which is relatively simple to manufacture so that the manufacturing scrap rate can be minimized.

It is yet another object of the present invention to make such a fastener in which the journal member on the plate member will strongly and securely retain the connecting portion of the grasshopper spring.

Other objects, advantages and features of the present invention will become apparent from the following specification when taken in conjunction with the accompanying drawings.

BRIEF DESCRIPTION OF THE DRAWINGS

FIG. 1 is a plan view of a fastening device constructed according to the present invention in an open position.

FIG. 2 is a perspective view of the plate member of the fastening device of FIG. 1.

FIG. 3 is a perspective view of a molding core used in the fabrication of the plate member of FIG. 2.

DESCRIPTION OF THE PREFERRED EMBODIMENT

As is shown in FIG. 1, the present invention is embodied in a shoe, indicated generally at 10, having a closure formed by a pair of flaps 12 and 14 which are closed by a fastening device, indicated generally at 16. The fastening device 16 includes a grasshopper spring 18, a yoke spring 20, and a plate member 22. The grasshopper spring 18 and the yoke spring 20 are formed by bent stiff metal wires while the plate member 22 is a unitarily molded thermoplastic member.

The grasshopper spring 18 is formed as a generally V-shaped member with a pair of arms 24 and 26 joined by a horseshoe-shaped connecting portion 28. A pair of sleeves 30 and 32 provided on the respective flaps 12 and 14 of the shoe 10 receive respectively one of two arm extensions 34 and 36 which extend from and double back on the arms 24 and 26. The arm extensions 34 and 36 terminate in hooked portions 38 and 40 which are looped onto the connecting portion 28.

The yoke spring 20 includes a looped yoke portion 42 which is looped about both of the arms 24 and 26 of the grasshopper spring 18. Extending from the yoke portion 42 of the yoke spring 20 are a pair of yoke legs 44 and 46 which extend in parallel away from the yoke portion 42. Both of the legs 44 and 46 terminate in respective locking pins 48 and 50 which are bent from the ends of the yoke legs 44 and 46 to extend laterally outward from the longitudinal axis of the yoke spring 20.

The plate member 22 is a generally flat thermoplastic member, the details of which can be better seen in FIG. 2. In FIG. 2 the back surface of the plate member 22 is shown, the front surface of the plate member 22 being provided with any decorative or textured surface which may be desired in the particular application inasmuch as the front is the surface of the fastening device 16 that will be seen once the device is closed. Formed at one end of the back surface of the plate member 22 is a yoke recess 54 from which extends upward a journal member 52. The journal member 52 is integrally formed around the connecting portion 28 of the grasshopper spring 18. The connecting portion 28 extends completely through the journal member 52 in a transverse direction and is free to pivot therein. Extending longitudinally along the back surface of the plate member 22 is a yoke channel 56. Toward the opposite end of the plate member 22 from the journal member 52 the yoke channel 56 is divided into two portions by a separator 58. Formed along both side wall surfaces of the yoke channel 56 intermediate the length of the plate member 22 are a series of adjustment holes 60. The adjustment holes 60 are holes which extend laterally into the sides of the plate member 22 adjacent the yoke channel 56 and are sized so as to be able to receive the locking pins 48 and 50 of the yoke spring 20. Each of the adjustment holes 60 is slotted towards the back surface of the plate member 22 by a molded slot 62. Each of the molded slots 62 is narrower than the adjacent adjustment hole 60 and than the locking pins 48 and 50. A pair of locking tabs 64 and 66 are provided on the back surface of the plate member 22 and extend over the sides of the yoke channel 56.

In its operation the fastening device 16 functions easily and swiftly to close and open the closure formed between the flaps 12 and 14 of the shoe 10. The fastening device 16 is operated by lifting the end of the plate member 22 to pivot the plate member 22 about the journal member 52. As the end of the plate member 22 is raised the yoke member 20 is pressed upwardly with the yoke portion 42 travelling upward along the arms 24 and 26. As the yoke member 42 travels up the arms 24 and 26, the arms 24 and 26 are brought together bringing with them the arm extensions 34 and 36, the sleeves 30 and 32 and thereby the flaps 12 and 14. When the plate member 22 has been pivoted to the limit of its movement the flaps 12 and 14 will have been brought together and the closure will have been fully closed. To secure the fastening device 16 in a closed position one merely further pushes on the plate member 22 to snap the locking tabs 64 and 66 over the legs 44 and 46 of the yoke spring 20. The yoke spring 20 is then largely received within the yoke channel 56, with the legs 44 and 46 being received on opposite sides of the separator 58. The connecting portion 28 and hook portions 38 and 40 of the grasshopper spring 18 are received within the yoke recess 54 of the plate member 16. As can be seen in FIG. 2 the end of the plate member 22 away from the jounral member 52 is canted or sloped on its back surface so as not to interfere with the yoke portion 42 of the yoke spring 14 when the legs 44 and 46 are captured by the locking tabs 64 and 66.

The tightness of locking of the fastening device 16 can be adjusted through the use of the adjustment holes 60. By pinching the legs 44 and 46 of the yoke spring 20 together the locking pins 48 and 50 can be withdrawn from the adjustment holes 60, they are received in after which can be reinserted in any other appropriate pair of the adjustment holes 60. This positioning of the locking pins 48 and 50 will vary the distance the yoke position 42 travels along the arms 24 and 26 in the final lock position of the fastening device 16 to thereby vary the tightness of the fastening of the closure. The molded slots 62 are provided for each of the adjustment holes 60 to aid in their formation during the fabrication of the plate member 22. The narrowness of the molded slots 62 ensures that the locking pins 48 and 50 will remain in the adjustment holes 60. In forming the plate member 22 the most difficult procedures are capturing the connecting portion 28 of the grasshopper spring 18 within the plate member 22 and forming of the adjustment holes 60. To capture the connection portion 28 of the grasshopper spring 18 the grasshopper spring 18 is first formed and the plate member 22 is molded with the connecting portion 28 inserted into the mold so that the journal member 52 is integrally formed at its inception with the connection portion 28 imbedded therein. Pivoting the connection portion 28 relative to the plate member 22 after the plate member 22 is removed from the mold frees the connection portion 28 to pivot freely within the journal member 52 which extends completely around it.

To form the adjustment holes 60 and the molded slots 62 a core 100, as shown in FIG. 3, is utilized. The core 100 includes an extension piece 102 designed to fit within and help form the yoke channel 56. The core 100 would include other features, not shown, which would allot it to inter-fit with the remainder of whatever mold is used to fabricate the plate member 22. Extending from the extension 102 are a series of hole cores 104 which are supported from the core 100 by slot cores 106. The slot cores 106 are provided to stiffen and support in place the hole cores 104. Without the slot cores 106 the hole cores 104 would have a tendency to break off and/or crack during the molding operation. The molding slots 62 are formed merely as an incident of the formation of the adjustment holes 60 and are included so that the hole cores 104 can be supported rigidly on the molding core 100. Of course, the slot cores 106 are sized such that the molding slots 62 as formed will be sufficiently narrow so that there is no chance that the locking pins 48 and 50 can pass therethrough. It has been found that by using the core similar to the core 100 and including the molding slots 62, the plate members 22 can be molded cheaply and efficiently and with less of a scrap rate than with any previously known method.

Inasmuch as the present invention is subject to many modifications, variations, and changes in detail, it is intended that all the subject matter in the aforegoing specification or in the accompanying drawings be interpreted as illustrative, rather than in a limiting sense.

What is claimed is:

1. A fastening device for fastening two flaps of a closure comprising a bent wire grasshopper spring including a connecting portion, a pair of arms extending from the connecting portion, a pair of arm extensions extending from the arms and attached to the closure flaps and a hooked portion on each arm extension hooked onto the connecting portion, a yoke spring including a yoke portion looped over the arms of the glasshopper spring, a pair of legs extending in parallel from the yoke portion and a locking pin extending outwardly from each leg, a molded thermoplastic plate member having a longitudinally elongated yoke channel and a yoke recess both formed in its back surface with the yoke recess being at one end thereof, a pair of locking tabs disposed on the back surface of the plate member and extending over opposite sides of the yoke channel, a journal member formed on the back surface of the plate member in the yoke recess, the journal member being integrally molded around the connecting portion of the grasshopper spring so that the connecting portion is freely pivotable but is securely retained within the journal member, and the plate member having formed in it along the sides of the yoke channel a plurality of adjustment holes adapted to receiving the locking pins of the yoke spring, each of the adjustment holes being slotted toward the back surface of the plate member by a molded slot so that the adjustment holes can be easily formed in the plate member, the molded slots being narrower than the locking pins so that the locking pins will be retained in the adjustment holes.

* * * * *